United States Patent [19]

Hamai

[11] Patent Number: 4,768,985

[45] Date of Patent: Sep. 6, 1988

[54] METHOD OF MANUFACTURING MINIATURE TIPLESS HALOGEN LAMP AND APPARATUS FOR CARRYING OUT THE SAME

[75] Inventor: Jitsuo Hamai, Tokyo, Japan

[73] Assignee: Hamai Electric Lamp Co., Ltd., Tokyo, Japan

[21] Appl. No.: 918,624

[22] Filed: Oct. 14, 1986

Related U.S. Application Data

[63] Continuation of Ser. No. 816,543, Jan. 6, 1986, abandoned.

[30] Foreign Application Priority Data

Jun. 26, 1985 [JP] Japan ..... 60-141160

[51] Int. Cl.[4] ..... H01J 9/395; H01J 9/34

[52] U.S. Cl. ..... 445/27; 445/39; 445/43; 445/70; 445/73

[58] Field of Search ..... 445/27, 39, 43, 66, 445/70, 73

[56] References Cited

U.S. PATENT DOCUMENTS

| | | | |
|---|---|---|---|
| 2,549,359 | 4/1951 | Bakanau | 445/67 |
| 2,553,749 | 5/1951 | Clark et al. | 445/66 |
| 3,040,204 | 6/1962 | Belknap | 445/70 X |
| 3,208,812 | 9/1965 | Brundige et al. | 445/27 |
| 3,460,219 | 8/1969 | Shiragaki | 445/27 |
| 3,589,790 | 6/1971 | Beane et al. | 445/39 |
| 3,704,927 | 12/1972 | Toomey et al. | 445/73 X |
| 3,716,285 | 2/1973 | Boyce | 445/27 |
| 3,788,724 | 1/1974 | Schenkels et al. | 445/39 |
| 3,854,786 | 12/1974 | Notelteirs et al. | 445/39 X |
| 3,884,540 | 5/1975 | Hamai | 445/27 |
| 3,967,871 | 7/1976 | Kerekes | 445/39 |
| 4,578,043 | 3/1986 | Teshima et al. | 445/43 |

*Primary Examiner*—Kenneth J. Ramsey

*Attorney, Agent, or Firm*—Flynn, Thiel Boutell & Tanis

[57] ABSTRACT

A method of manufacturing a miniature tipless halogen lamp having a diameter of 1.0 to 4.0 mm, in which an assembly of a pair of lead wires, a bead welded to the lead wires and a filament connected to the lead wires by pressing flat and crimping the inner ends of the lead wires, the assembly is put in a lamp bulb in place to form an unfinished assembly of the components of the miniature tipless halogen lamp, a plurality of such unfinished assemblies are placed in an apparatus including an integral and airtight combination of a holagen gas introducing sealed box and a heat-sealing box, the lamp bulbs of the unfinished assemblies are sealed by being heated with a heat-sealing carbon plate at a position corresponding to the bead, and then unnecessary portions of the lamp bulbs are cut off to complete the miniature tipless halogen lamps. In manufacturing the miniature tipless halogen lamp, any tip for introducing a halogen gas into the lamp bulb need not be formed in the lamp bulb and the lamp bulb can be formed beforehand in a predetermined form. The apparatus is capable of heat-sealing a plurality of the unfinished assemblies at a time.

7 Claims, 4 Drawing Sheets

METHOD OF MANUFACTURING MINIATURE TIPLESS HALOGEN LAMP AND APPARATUS FOR CARRYING OUT THE SAME

This application is a continuation of U.S. Ser. No. 816,543, filed Jan. 6, 1986, now abandoned.

BACKGROUND OF THE INVENTION

1. Field of the Invention:

The present invention relates to a method of manufacturing a miniature tipless halogen lamp of a diameter within the range of some 1.0 to 4.0 mm, capable of radiating intensive white light and being employed in apparatus employing an optical fiber cable, such as sensors, automatic controllers, industrial robots and medical appliances, particularly, endoscopes, for illumination through an optical fiber cable, and an apparatus for carrying out the method.

2. Description of the Prior Art:

In manufacturing a conventional miniature halogen lamp, a gas introducing pipe (designated generally as "tip" in the related industry, and hence will be referred to as "tip" hereinafter) is fused off to seal the lamp bulb after introducing a gas into the lamp bulb. Accordingly, when the internal pressure of the lamp bulb increases above the atmospheric pressure due to heating for fusing-off the tip and the resultant thermal expansion of the gas introduced into the lamp bulb, the gas spouts through the fused tip, and hence it is impossible to seal the lamp bulb. Therefore, when the internal pressure of the lamp bulb needs to be higher than the atmospheric pressure, the lamp bulb containing the gas needs to be cooled by liquid nitrogen or the like in sealing the lamp bulb by fusing-off the tip. Furthermore, according to the prior art, since a discharge pipe and the tip are provided in the head or the bottom of the lamp bulb and the discharge pipe and the tip are fused off after use, the traces of the discharge pipe and the tip remains inevitably in the finished lamp. Still further, when the tip is formed in the head of the lamp bulb, it is impossible to formalize the lamp as the natural consequence, while it is impossible to form the tip in the bottom of the bulb because the lead wires need to be provided in the bottom of the bulb with a very small gap therebetween to form a very small lamp. Accordingly, it has been impossible to provide a lens in the head of a miniature halogen lamp or to formalize miniature halogen lamps.

SUMMARY OF THE INVENTION

Accordingly, it is an object of the present invention to provide a method of manufacturing a miniature tipless halogen lamp of very small size as compared with the conventional miniature halogen lamps.

It is another object of the present invention to provide an apparatus for manufacturing such a miniature tipless halogen lamp.

According to the present invention, a gas introducing sealed box and a heat-sealing sealed box are combined in an integral unit and a plurality of lamp bulbs are sealed simultaneously by means of a carbon plate without fusing off the lamp bulbs. Thus, the present invention is capable of manufacturing a plurality of high-quality miniature halogen lamps of uniform performance at a time.

The above and other objects, features and advantages of the present invention will become more apparent from the following description of a preferred embodiment thereof taken in conjunction with the accompanying drawings.

DESCRIPTION OF THE PREFERRED EMBODIMENT

Figure 1:
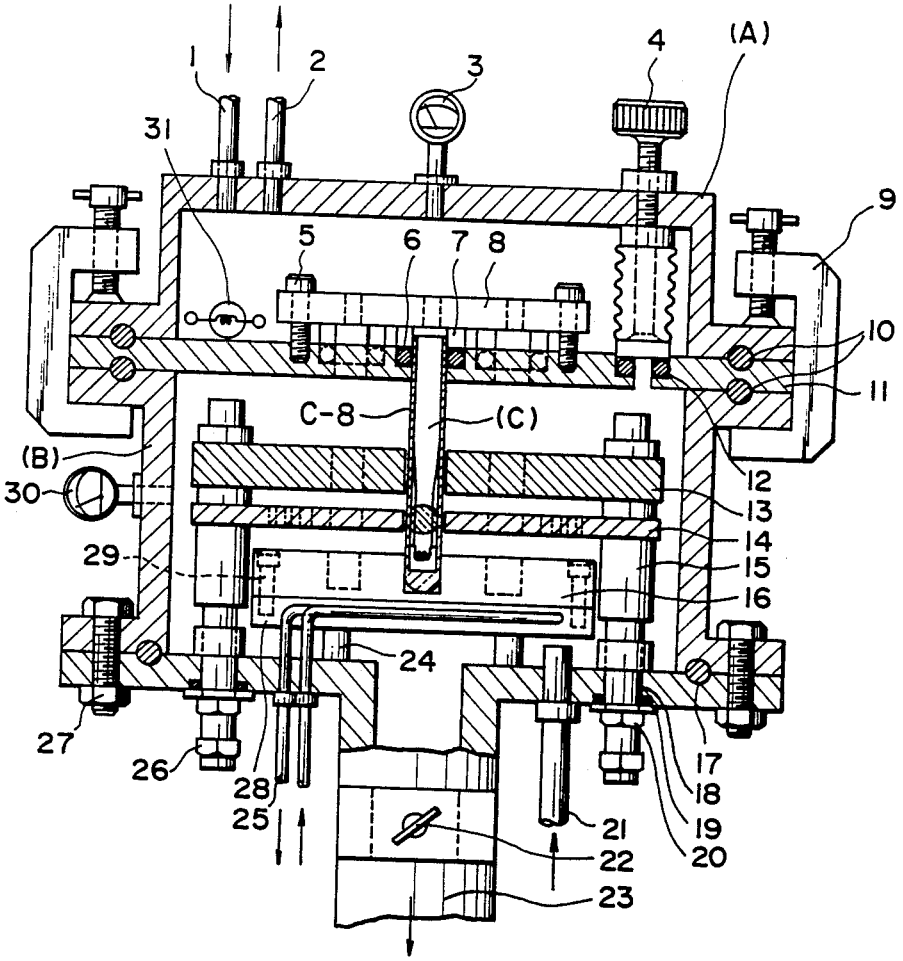
FIG. 1 is a sectional view of a miniature tipless halogen lamp manufacturing apparatus, in a preferred embodiment, according to the present invention.

FIG. 1 is a sectional view of a miniature tipless halogen lamp manufacturing apparatus according to the present invention, including a double-box structure consisting of a hologen gas introducing sealed box A and a heat-sealing box B. The halogen gas introducing box A is a corrosion resistant box, while the heat-sealing sealed box B is a high-pressure vessel.

Figure 2:
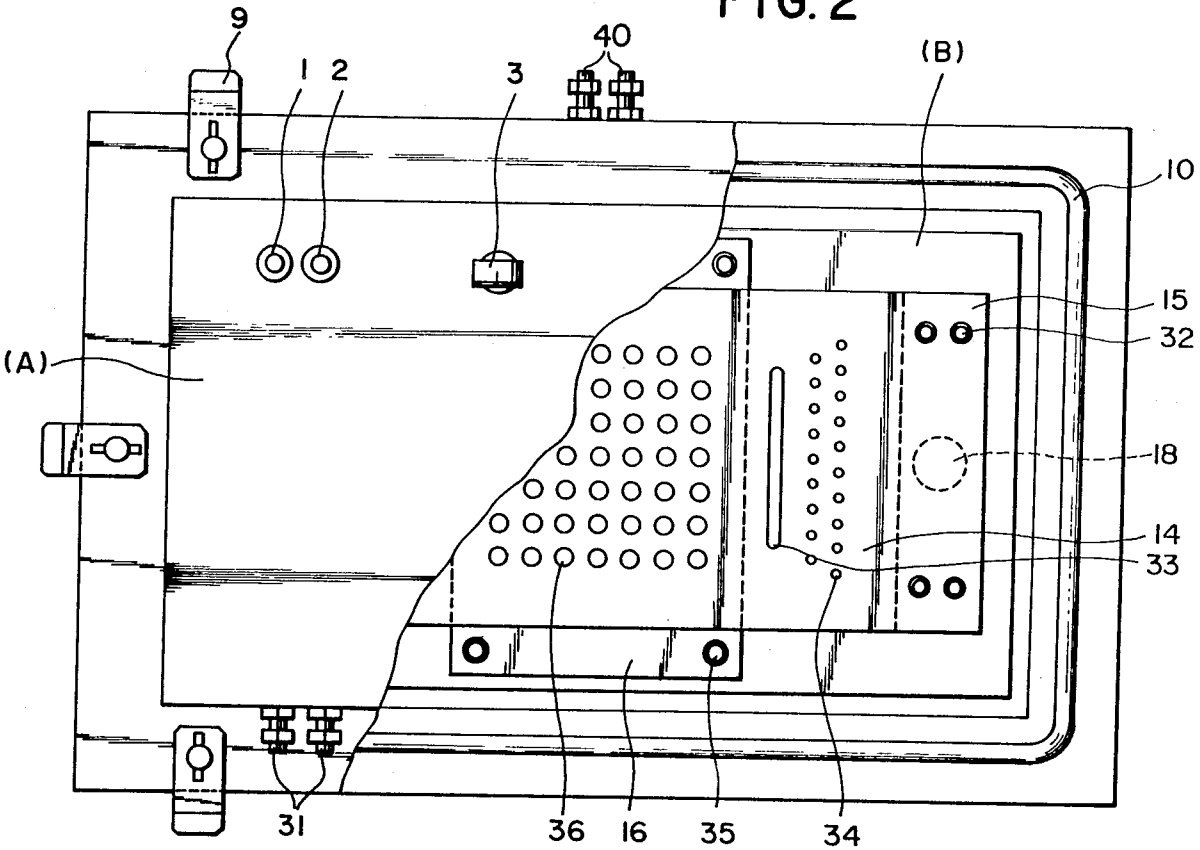
FIG. 2 is a partly cutaway plan view of the miniature tipless halogen lamp manufacturing apparatus of FIG. 1, as viewed from the side of a halogen gas introducing sealed box (A), in which part of a carbon jig is shown.

In FIGS. 1 and 2, there are shown: a halogen gas supply pipe 1 formed of a corrosion-resistant metal for supplying a corrosive gas into the halogen gas introducing sealed box A; a gas discharge pipe 2 formed of the same material as the halogen gas supply pipe 1; a pressure gauge 3 for indicating the pressure of the halogen gas prevailing within the halogen gas introducing sealed box A; a bellows valve 4 for maintaining the perfect airtightness of the halogen gas introducing sealed box A; fastening bolts 5; corrosion-resistant O-rings 6 for holding lamp bulbs and for maintaining the perfect airtightness of the halogen gas introducing sealed box A and the heat-sealing sealed box B; O-ring fastening rings 7 interposed between the corrosion resistant O-rings 6 and a corrosion-resistant O-ring fastening plate 8 for correctly fastening the O-rings 6; clamps 9 for airtightly fastening the halogen gas introducing sealed box A and the heat-sealing sealed box B together in a single unit; O-rings 10 for sealing the halogen gas introducing sealed box A and the heat-sealing sealed box B; the bottom plate 11 of the halogen gas introducing sealed box A; an O-ring 12 for the bellows valve; a heat-insulating plate 13; a carbon plate 14 having heat weirs 33 and several holes 34 for heating the sealed portions at a uniform temperature, and a plurality of sealing holes 36; an electrode 15 for supplying an electric current to the carbon plate 14; a cooling plate 16 for holding lamp bulbs and for cooling the heads of the lamp bulbs so that the halogen gas is sealed in the lamp bulbs at a high concentration; an O-ring 17 for sealing the heat-sealing sealed box B; an insulating ring 18 for insulating the heat-sealing sealed box B from the electrode 15; a heat-resistant O-ring 19 for sealing a hole formed in the heat-sealing sealed box B for receiving the electrode 15 therethrough; a nut 20 for fastening the heat-resistant O-ring 19; an inert gas supply pipe 21; a valve 22 provided in an evacuating pipe 23 connected to a high-vacuum exhauster, not shown; a cooling plate supporting bed 24; a cooling liquid circulating pipe 25 for circulating a cooling liquid through a cooling block 28 as indicated by arrows; bolts 29 fastening the cooling plate 16 and the cooling block 28 together; a pressure gauge 30 for indicating the gas pressure prevailing within the heat-sealing sealed box B; corrosion-resistant electric heaters 31 for heating the interior of the halogen gas introducing sealed box A to raise the pressure of the halogen gas supplied into the halogen gas introducing sealed box A so that the halogen gas is sealed in the lamp bulbs C-8 at a high concentration; screws 32 fastening the electrode 15 to the carbon plate 14; screws 35 fastening the cooling block 28; and a plurality of bulb sealing holes 36 formed in the carbon plate 14 for sealing a plurality of the lamp bulbs C-8 at a time.

The fastening plate 8 is provided with a plurality of holes in alignment with the bulbs sealing holes 36 formed in the carbon plate 14 to supply a halogen gas into the lamp bulbs C-8 therethrough.

A plurality of holes are formed in the heat insulating plate 13 so as to align with the sealing holes 36 of the carbon plate 14.

A thermoelectric thermometer 40 is provided beside the carbon plate 14 with the measuring element, not shown, thereof disposed at a position corresponding to the bead positioned in the lamp bulb C-8 for the heat-sealing process as illustrated in FIG. 1. The thermoelectric thermometer 40 is connected to a temperature controller, which regulates the temperature of the carbon plate 14.

Figure 3:
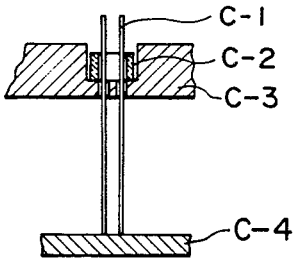
FIGS. 3 (*a*), 3 (*b*), 3 (*c*), 3 (*d*), 3 (*e*), 3 (*f*), 3 (*g*) and 3 (*h*) are illustratings of assitance in explaining steps of assembling a miniature tipless halogen lamp according to the present invention.
Figure 3:
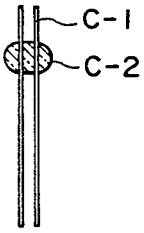
Figure 3:
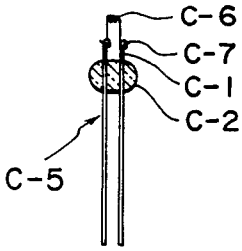
Figure 3:
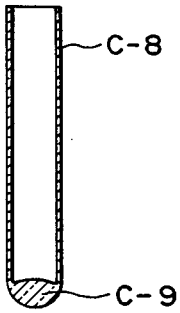
Figure 3:
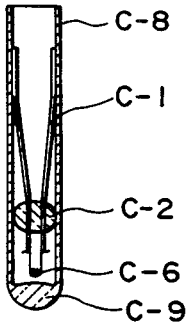
Figure 3F:
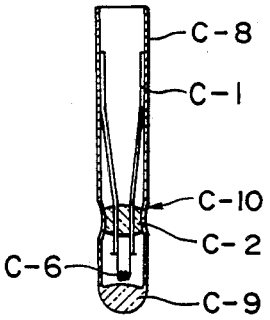
Figure 3G:
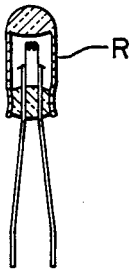
Figure 3H:
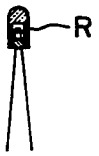

FIGS. 3 (*a*) to 3 (*h*) illustrates a series of processes for assembling the miniature tipless halogen lamp according to the present invention. FIG. 3 (*a*) is a sectional view showing a combination of lead wires C-1 and a bead C-2 put in place on a bead heating carbon plate C-3 and a lead wire holding carbon jig C-4 for fusing the bead C-2. FIG. 3(*b*) shows lead wires C-1 and the bead C-2 after the bead C-2 has been fused and joined to the lead wires C-1. FIG. 3 (*c*) is a sectional view of an assembly of the lead wires C-1, the bead C-2 and a filament C-6, in which to fasten the opposite ends of the filament C-6, the respective inner ends C-7 of the lead wires C-1 are bent and crimped to fasten the opposite ends of the filament C-6 to the lead wires C-1. FIG. 3 (*d*) is a sectional view of a lamp bulb C-8 having a lens C-9. The lamp bulb C-8 serves also as a gas introducing pipe during the assembling process. FIG. 3 (*e*) is a sectional view of a combination of the assembly of the lead wires C-1, the bead C-2 and the filament C-6, and the lamp bulb C-8, put in place for sealing the lamp bulb C-8. FIG. 3 (*f*) is a sectional view of the assembly of the lead wires C-1, the bead C-2, the filament C-6 and the lamp bulb C-8, in which the bead C-2 and a portion of the lamp bulb C-8 corresponding to the bead C-2 are fused together to seal the lamp bulb C-8. The upper portion of the lamp bulb C-8 above the bead C-2 is out off at a position C-10 after the lamp bulb C-8 has been sealed. FIG. 3 (*g*) is a sectional view of a complete miniature tipless halogen lamp R. FIG. 3 (*h*) shows the complete miniature tipless halogen lamp R in the actual size.

A series of steps of manufacturing the miniature tipless halogen lamp R will be described hereinafter with reference to FIGS. 1 and 3 (*a*) to 3 (*g*).

First the lead wires C-1 are held on the bead heating carbon plate C-3 and the lead wire holding carbon jig C-4 and the bead C-2 is set in place on the bead heating carbon plate C-3, as illustrated in FIG. 3 (*a*). Then, the bead heating carbon plate C-3 is heated to fuse the bead C-2 to weld the lead wires C-1 and the bead C-2 together so that an assembly of the lead wires C-1 and the bead C-2 as illustrated in FIG. 3 (*b*) is produced. Secondly, the respective inner ends, namely, the upper ends as viewed in FIG. 3*b*, of the lead wires C-1 are pressed flat and crimped to join the filament C-6 to the lead wires C-1, as illustrated in FIG. 3*c*, and then the respective outer portions, namely, the lower portions as viewed in FIG. 3*c*, of the lead wires C-1 are bent away from each other to complete a lighting element C-5, as illustrated in FIG. 3*c*. Then, the lighting element C-5 is put in the lamp bulb C-8 to assemble an unfinished assembly C of the lead wires C-1, the bead C-2, the filament C-7 and the lamp bulb C-8, as illustrated in FIGS. 1 and 3*e*.

Then, a plurality of such unfinished assemblies C are inserted through the holes of the heat insulating plate 13 and the heat-sealing carbon plate 14 so that the heads of the lamp bulbs C-8 are received and held in the holes of the cooling plate 16, respectively. Then, the O-ring fastening plate 8 is fastened to hold the unfinished assemblies C airtightly in the heat-sealing sealed box B.

Then, the halogen gas introducing sealed box A is mounted on and fastened to the heat-sealing sealed box B by means of the clamps 9. After the halogen gas introducing sealed box A and the heat-sealing sealed box B has been thus fastened together and sealed, the bellows valve 4 and the valve 22 are opened to evacuate the halogen gas introducing sealed box A and the heat-sealing sealed box B, and the cooling liquid is circulated through the cooling block 28. After closing the bellows valve 4 to seal the halogen gas introducing sealed box A, the halogen gas of a predetermined pressure is supplied through the halogen gas supply pipe 1 into the halogen gas introducing sealed box A. On the other hand, the valve 22 is closed, and then an inert gas is supplied through the inert gas supply pipe 21 into the heat-sealing sealed box B until the internal pressure of the heat-sealing sealed box B reaches a predetermined level. Then, an electric current is supplied to the corrosion-resistant heaters 31 provided within the halogen gas introducing sealed box A to heat the halogen gas supplied into the halogen gas introducing sealed box A in order to raise the pressure of the halogen gas, and thereby the halogen gas is introduced into the lamp bulbs C-8 at the highest possible concentration. Then, an electric current is supplied to the carbon plate 14 having the heat weirs and several holes for uniformly heat forming the portions of the lamp bulbs C-8 to be sealed, through the electrode 15 to heat-seal the lamp bulbs C-8 at a suitable temperature under the automatic temperature control of the temperature controller. Upon the completion of the heat-sealing of the lamp bulbs C-8, the power supply to the carbon plate 14 and to the heaters 31 is interrupted to stop heating. According to the present invention, the lamp bulb C-8 is formed beforehand in a predetermined form having the lens C-9 in the head portion, and the extended upper portion above the position C-10, as viewed in FIG. 3 (*f*), serves as a tip. Thus, the miniature tipless halogen lamp R is completed by cutting off the upper portion of the lamp bulb C-8 above the position C-10, after completely sealing the lamp bulb C-8 at a position corresponding to the bead C-2.

As is apparent from what has been described hereinbefore, the miniature tipless halogen lamp produced by the method of the present invention has a very small external size as compared with the corresponding conventional miniature halogen lamp; for example, the diameter of the smallest conventional miniature halogen lamp is about 4.7 mm, whereas the diameter of the miniature tipless halogen lamp manufactured by the method of the present invention is as small as about 1.0 mm. Although the invention has been described as applied to manufacturing a halogen lamp, naturally, the present invention is applicable to manufacturing halogen lamps, krypton lamps, xenon lamps and other gas-filled lamps. The miniature tipless halogen lamp manufactured by the method of the present invention enables the reduction of the size of apparatus and enables the insertion of the illuminating head employing the miniature tipless halogen lamp of the present invention in a place where is impossible to be illuminated from outside. Thus the miniature tipless halogen lamp of the present invention is effectively applicable to diverse purposes in various industrial fields in combination with optical fibers.

Although the invention has been described in its preferred embodiment with a certain degree of particularity, it is to be understood that many changes and variations are possible in the invention without departing from the scope and spirit thereof.

What is claimed is:

1. A method of manufacturing a miniature tipless halogen lamp, comprising steps of:

(a) inserting lead wires through a bead heating carbon plate and holding the lead wires by a lead wire holding carbon jig;

(b) fitting a bead on the lead wires and setting the bead in place on the bead heating carbon plate;

(c) heating the bead heating carbon plate to fuse and weld the bead to the lead wires;

(d) connecting the opposite ends of a filament to the respective inner ends of the lead wires, respectively, by pressing flat and crimping the inner ends of the lead wires to form a lighting element;

(e) inserting the lighting element in a preformed lamp bulb to form an unfinished assembly of the lead wires, the bead, the filament and the lamp bulb;

(f) inserting a plurality of the unfinished assemblies through holes formed in the bottom plate of a halogen gas introducing sealed box, and a heat insulating plate and a heat-sealing carbon plate disposed within a heat-sealing sealed box, into holding holes formed in a cooling plate disposed within the heat-sealing sealed box;

(g) airtightly fastening the upper portions of the unfinished assemblies to the bottom plate of the halogen gas introducing sealed box by means of a plurality of O-rings, a plurality of O-ring fastening rings and a fastening plate;

(h) airtightly fastening the halogen gas introducing sealed box and the heat-sealing sealed box together;

(i) opening a cock closing a through hole formed in the bottom wall of the halogen gas introducing sealed box to allow the halogen gas introducing sealed box to communicate with the heat-sealing sealed box;

(j) evacuating the halogen gas introducing sealed box and the heat-sealing sealed box;

(k) closing the cock to isolate the halogen gas introducing sealed box and the heat-sealing sealed box from each other;

(l) supplying a halogen gas of a predetermined pressure into the halogen gas introducing sealed box;

(m) supplying an inert gas of a predetermined pressure into the heat-sealing sealed box;

(n) heating the halogen gas supplied into the halogen gas introducing sealed box with heating means provided within the halogen gas introducing sealed box to introduce the halogen gas into the lamp bulbs of the unfinished assemblies at a high concentration;

(o) heating the heat-sealing carbon plate at a predetermined temperature to heat-seal the lamp bulbs of the unfinished assemblies at a position corresponding to the bead, and cooling the heads of the lamp bulbs by circulating a cooling liquid through a cooling block closely joined to the cooling plate;

(p) interrupting the operation of the heating means and power supply to the heat-sealing carbon plate; and (q) cutting off the unnecessary portion of each lamp bulb extending away from the sealed portion corresponding to the bead away from the head to complete the miniature tipless halogen lamp.

2. An apparatus for manufacturing a miniature tipless halogen lamp, comprising:

(a) a halogen gas introducing sealed box having:

a plurality of holes formed in the bottom wall thereof for receiving a plurality of unfinished lamp assemblies each having a pair of lead wires, a bead welded to the lead wires, a filament connected to the lead wires and a lamp bulb containing the assembly of the lead wires, the bead and the filament, a halogen gas supply pipe, a gas discharge pipe, a pressure gauge for indicating the internal pressure, O-rings provided at the upper edges of the holes formed in the bottom wall for sealing the unfinished assemblies inserted through the holes, O-ring fastening rings placed on the O-rings, respectively, a fastening plate for fastening the O-rings through the O-ring fastening rings to seal the holes and hold the unfinished assemblies, and a valve for closing a hole formed in the bottom wall;

(b) a heat-sealing sealed box having:

a heat insulating plate having a plurality of holes for receiving the unfinished assemblies therethrough, heat-sealing carbon plate disposed below the insulating plate and having holes for receiving the unfinished assemblies therethrough, and for heating the unfinished assemblies at a position corresponding to the bead placed in the lamp bulb to seal the lamp bulb, heat weirs and several holes for controlling temperature distribution over the heat-sealing carbon plate so that the lamp bulbs inserted through the holes for receiving the unfinished assemblies are heated uniformly, a cooling plate disposed below the heat-sealing carbon plate and having a plurality of recesses for receiving the heads of the lamp bulbs of the unfinished assemblies to cool the latter during heat-sealing process, an electrode assembly for supplying an electric current to the heat-sealing carbon plate for sealing the lamp bulbs of the unfinished assemblies, an exhaust pipe for evacuating the heat-sealing sealed box connected to an external high-vacuum exhauster, a shutoff valve provided in the exhaust pipe, and an inert gas supply pipe for supplying an inert gas into the heat-sealing sealed box, and a pressure gauge for indicating the internal pressure of the heat-sealing sealed box; and (c) clamping means for fastening the halogen gas introducing sealed box and the heat-sealing sealed box together.

3. An apparatus for manufacturing a miniature tipless halogen lamp according to claim 2, wherein said halogen gas introducing sealed box is a corrosionresistant sealed box capable of enduring a high pressure that works on the box during the heat-sealing process.

4. An apparatus for manufacturing a miniature tipless hlogen lamp according to claim 2, wherein said halogen gas introducing sealed box and said heat-sealing box are detachably and airtigthly joined together in a single unit by means of said clamping means for operation.

5. An apparatus for manufacturing a miniature tipless halogen lamp, comprising:

(a) a halogen gas-introducing sealed box having (1) a plurality of holes formed in a bottom wall thereof for receiving a plurality of unfinished lamp assemblies each having a pair of lead wires welded within a bead and positioned within a lamp bulb, (2) a halogen gas inlet communicating therewith, (3) a gas discharge communicating therewith, and (4) seal rings provided at the holes for sealingly engaging the unfinished assemblies inserted through the holes;

(b) a heat-sealing sealed box having (1) a heat insulating plate having a plurality of holes for receiving the unfinished assemblies therethrough, (2) a heat-sealing plate having holes for receiving the unfinished assemblies and for heating the unfinished assemblies at a position corresponding to the bead placed in the lamp bulb to seal the lamp bulb, (3) a cooling plate disposed below the heat-sealing plate and having a plurality of recesses for receiving the heads of the lamp bulbs of the unfinished assemblies to cool the latter during the heat-sealing process, (4) an exhaust conduit for evacuating the heat-sealing sealed box, (5) valve means provided in the exhaust conduit, and (6) an inert gas supply conduit for supplying an inert gas into the heat-sealing sealed box;

(c) opening means providing communication between said gas-introducing and heat-sealing sealed boxes, and valve means associated with said opening means for selectively isolating them from one another; and (d) means for fastening the halogen gas-introducing and heat-sealing sealed boxes together.

6. An apparatus for manufacturing a miniature tipless halogen lamp according to claim 5, wherein said halogen gas-introducing sealed box and said heat-sealing sealed box are detachably and airtightly joined together as a single unit by said fastening means.

7. A method of manufacturing a miniature tipless halogen lamp, comprising steps of:

(a) fitting a bead on a pair of lead wires;

(b) fusing the bead to the lead wires;

(c) connecting the opposite ends of a filament to the respective inner ends of the lead wires, respectively, to form a lighting element;

(d) inserting the lighting element in a preformed lamp bulb to form an unfinished assembly;

(e) inserting a plurality of the unfinished assemblies through holes in a bottom plate of a halogen gas-introducing sealed box into holding holes formed in a cooling plate structure disposed within a heat-sealing sealed box so that the bead and surrounding portion of the lamp are positioned in the heat-sealing box but the interior of the lamp is in open communication with the halogen gas-introducing sealed box;

(f) airtightly fastening the lamp bulbs of the unfinished assemblies to the bottom plate of the halogen gas-introducing sealed box;

(g) evacuating the halogen gas-introducing sealed box and the heat-sealing sealed box;

(h) isolating the interiors of the halogen gas-introducing sealed box and the heat-sealing sealed box from each other;

(i) supplying halogen gas of predetermined pressure into the halogen gas-introducing sealed box;

(j) supplying an inert gas of predetermined pressure into the heat-sealing sealed box;

(k) heating the halogen gas within the halogen gas introducing sealed box to introduce the halogen gas into the lamp bulbs of the unfinished assemblies at a high concentration;

(l) heating the lamp bulbs of the unfinished assemblies at a position corresponding to the bead to heat-seal the bulbs to the respective beads, and cooling the heads of the lamp bulbs by circulating a cooling fluid through the cooling plate structure;

(m) interrupting the heating of the halogen gas and of the lamp bulbs; and (n) cutting off the unnecessary portion of each lamp bulb extending from the sealed portion away from the head to complete the miniature tipless halogen lamp.

* * * * *